US012594473B2

(12) United States Patent
Qiu

(10) Patent No.: US 12,594,473 B2
(45) Date of Patent: Apr. 7, 2026

(54) VOLLEYBALL TRAINING DEVICE

(71) Applicant: Weiping Qiu, Guangzhou (CN)

(72) Inventor: Weiping Qiu, Guangzhou (CN)

(73) Assignee: Guangzhou Shifen Technology Co., Ltd., Guangzhou (CN)

( * ) Notice: Subject to any disclaimer, the term of this patent is extended or adjusted under 35 U.S.C. 154(b) by 0 days.

(21) Appl. No.: 19/330,829

(22) Filed: Sep. 17, 2025

(65) Prior Publication Data

US 2026/0014441 A1 Jan. 15, 2026

(51) Int. Cl.
*A63B 69/00* (2006.01)
*A63B 47/00* (2006.01)

(52) U.S. Cl.
CPC ..... *A63B 69/0095* (2013.01); *A63B 47/002* (2013.01); *A63B 2225/093* (2013.01)

(58) Field of Classification Search
CPC ..... A63B 69/0095; A63B 47/002; A63B 69/0075; A63B 2225/093
See application file for complete search history.

(56) References Cited

U.S. PATENT DOCUMENTS 4,254,755 A * 3/1981 Morgan ..... A63B 69/408 124/16
4,798,390 A * 1/1989 Dooley ..... A63B 47/002 473/459
5,520,397 A * 5/1996 Thompson ..... A63B 69/0095 473/459
5,980,399 A * 11/1999 Campbell ..... A63B 69/409 124/72
7,001,289 B1 * 2/2006 Polega ..... A63B 47/002 473/473
7,445,568 B1 * 11/2008 Steffensmeier .... A63B 69/0095 473/430
8,371,964 B2 * 2/2013 Jones ..... A63B 69/0075 473/422

(Continued)

FOREIGN PATENT DOCUMENTS

CN 108992890 A * 12/2018 ..... A63B 69/40
CN 109999459 A * 7/2019 ..... A63B 69/0095

(Continued)

*Primary Examiner* — Raleigh W Chiu

(57) ABSTRACT

A volleyball training device, including: a mounting mechanism, a collection mechanism and a ball-control mechanism. The mounting mechanism is configured to secure the volleyball training device to a position for use. The collection mechanism is configured to receive and temporarily store balls. The ball-control mechanism and/or the collection mechanism are connected to the mounting mechanism, and the ball-control mechanism is located below the collection mechanism. The ball-control mechanism includes a ball-control assembly and an abutment member, and the ball-control assembly defines a spiking position and configured to position a first ball the abutment member rotatably connected to the ball control assembly and configured to selectively abut or release a second ball from the collection mechanism; when the first ball is spiked and moves out of the spiking position, the abutting member rotates from an abutting state to a released state, allowing the second ball to descend to the spiking position.

19 Claims, 10 Drawing Sheets

(56) References Cited

U.S. PATENT DOCUMENTS

| | | | | |
|---|---|---|---|---|
| 2012/0104190 | A1* | 5/2012 | Parent | E04H 12/2223<br>248/156 |
| 2012/0165134 | A1* | 6/2012 | Jones | A63B 69/0095<br>473/417 |
| 2014/0135152 | A1* | 5/2014 | Kurek | A63B 69/0075<br>473/459 |

FOREIGN PATENT DOCUMENTS

| | | | | |
|---|---|---|---|---|
| KR | 1647118 | B1 * | 8/2016 | A63B 65/12 |
| KR | 101647118 | B1 * | 8/2019 | A63B 69/0095 |
| KR | 20250128534 | A * | 8/2025 | A63B 69/0095 |

* cited by examiner

VOLLEYBALL TRAINING DEVICE

TECHNICAL FIELD

The present disclosure relates to the technical field of sport training devices, in particular to a volleyball training device.

BACKGROUND OF THE INVENTION

In recent years, the participation and popularity of volleyball have significantly increased over the world. Whether in the high schools and the universities or Olympic Games, volleyball has attracted a growing number of participants. Spike, as one of the most offensive and decisive technical actions in volleyball matches, is a main score way during the matches. Therefore, high-quality spiking training is crucial for enhancing the technical level of a volleyball player. With the increase in training intensity and the level of specialization, traditional manual ball-feeding methods can no longer meet the demands of high-intensity, standardized, and continuous spiking training, there are issues such as low training efficiency, inconsistent hitting rhythm, and imprecise positioning. Accordingly, volleyball training devices have emerged.

However, many existing volleyball training devices currently lack these drawbacks, such as complex structures, redundant functions, and difficulties in installation and debugging. Moreover, many overly rely on large support frames or fixed installation structures, resulting in bulky equipment, poor mobility, and limited applicability, making them difficult to promote and use in teaching training, grassroots sports organizations, and household scenarios. Additionally, prior volleyball training devices heavily depend on ball collection mechanisms for supplying balls to the spiking position, it made it impossible to practice spiking. The automatic ball-replenishing functionality is notably insufficient, sometimes requiring manual assistance, which reduces training efficiency.

In light of the above, the present disclosure provides a volleyball training device which can not only meet to respond to the aforesaid needs, but also has a simple structure, allows for easy assembly and disassembly, automatically replenishes volleyballs, and significantly enhances training efficiency.

SUMMARY OF THE INVENTION

In order to overcome these drawbacks of prior arts, the present disclosure provides a volleyball training device that has a simple structure, allows for easy assembly and disassembly, automatically replenishes volleyballs, and significantly enhances training efficiency.

The technical solution adopted in the present disclosure to solve the technical problem is as follows:

A volleyball training device includes: a mounting mechanism, a collection mechanism and a ball-control mechanism.

The mounting mechanism is configured to secure the volleyball training device to a position for use.

The collection mechanism is configured to receive and temporarily store balls.

The ball-control mechanism and/or the collection mechanism are connected to the mounting mechanism, and the ball-control mechanism is located below the collection mechanism. The ball-control mechanism includes a ball-control assembly and an abutment member, and the ball-control assembly defines a spiking position and configured to position a first ball the abutment member rotatably connected to the ball control assembly and configured to selectively abut or release a second ball from the collection mechanism; when the first ball is spiked and moves out of the spiking position, the abutting member rotates from an abutting state to a released state, allowing the second ball to descend to the spiking position.

By the arrangement of the above structure, during use, the mounting mechanism securely attaches the volleyball training device to a position for use, such as a basketball hoop or a support rod, ensuring safety and precise positioning during training. The function of the collection mechanism is to centrally store multiple volleyballs, which adapts to the training needs of different users or court conditions. As a temporary storage structure for volleyballs, the collection mechanism ensures continuous ball feeding. The ball-control mechanism serves as the core structure for achieving automatic continuous ball feeding. The ball-control assembly defines the strike position, and positions the first ball at a preset strike position. The ball-control assembly can ensure consistent starting points for each user's striking, and enhance the standardization and repeatability of training. The collection mechanism and/or the ball-control mechanism are connected to the mounting mechanism to ensure the stability of the volleyball training device. The abutment member, which can be rotatably connected to the ball-control assembly, abuts the second ball located above the first ball. So that the abutment member can prevent the second ball from descending prematurely and avoid interference with user's spiking training. When a user spikes the first ball located in the spiking position, then the first ball moves out from the spiking position, the abutment member is automatically triggered to rotate, enabling the abutment member disengage (no longer abut) the second ball, while the abutment member rotate from the abutting state to the released state against the second ball. Once the abutment member rotates (from the abutting state to the released state), the second ball automatically descends to the spiking position under the gravity, enabling the user to prepare for the next striking training. This device significantly enhances training efficiency for the user, making the device an excellent choice for practicing volleyball spikes for both athletes and amateurs.

BRIEF DESCRIPTION OF DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE INVENTION

Figure 1:
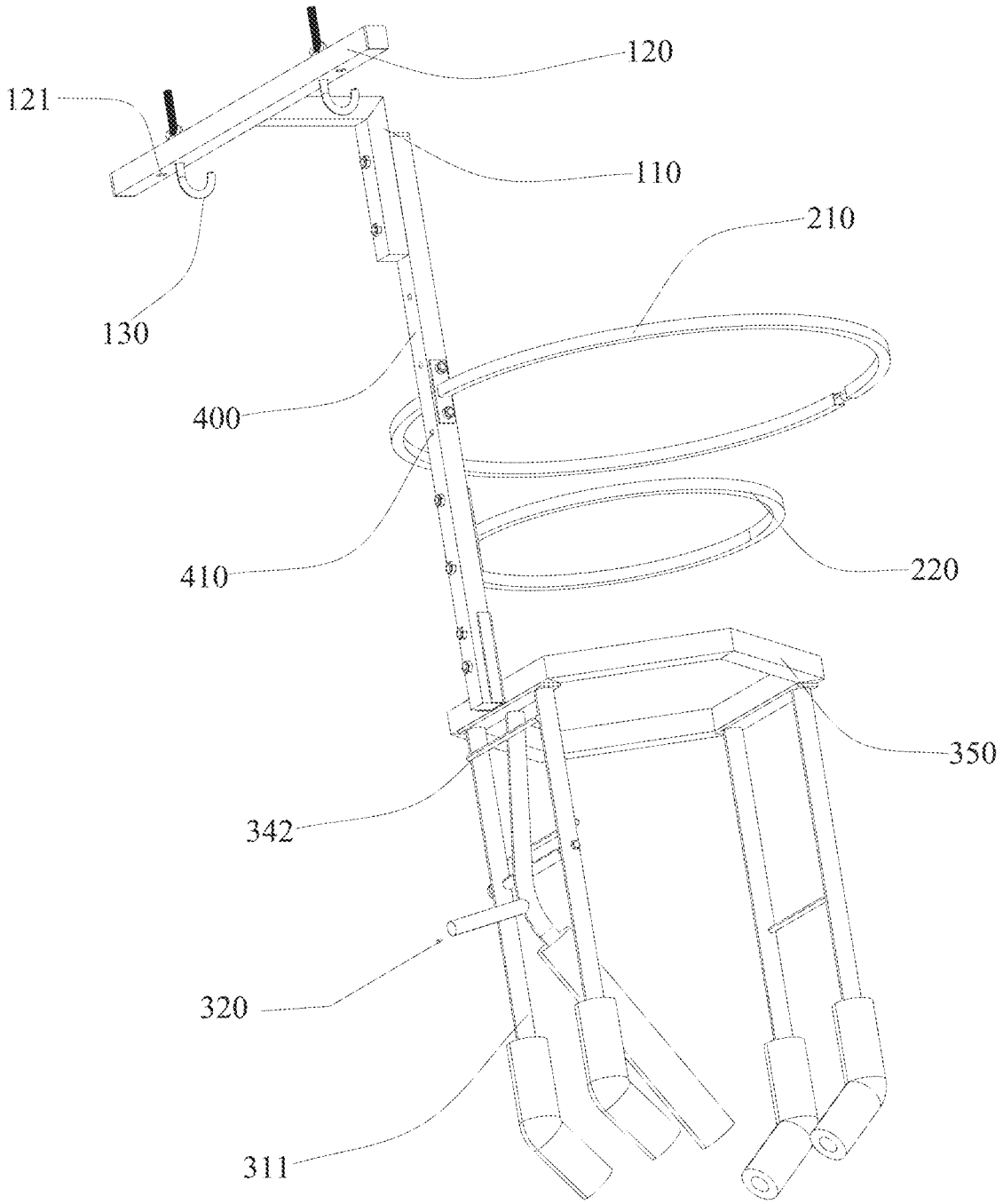
FIG. 1 shows an overall schematic structural view of the disclosure.

To make the aforementioned objectives, features, and advantages of the present disclosure more comprehensible, specific implementations of the present disclosure are described in detail below in conjunction with the accompanying drawings. In the following description, numerous specific details are set forth to provide a thorough understanding of the present disclosure. The present disclosure may, however, be embodied in many forms different from that described here. A person skilled in the art can make similar improvements without departing from the connotation of the present disclosure. Therefore, the present disclosure is not limited by the specific embodiments disclosed below.

In the description of the present disclosure, It is to be understood that, The terms "center", "longitudinal", "transverse", "upper", "lower", "front", "rear", "left", "right", "vertical", "horizontal", "top", "bottom", "inner", "outer", "clockwise", "counterclockwise", and the like indicate azimuth or positional relationships based on the azimuth or positional relationships shown in the drawings, For purposes of convenience only of describing the present disclosure and simplifying the description, Rather than indicating or implying that the indicated device or element must have a particular orientation, be constructed and operated in a particular orientation, therefore, not to be construed as limiting the present disclosure.

In addition, the terms "first" and "second" are used for descriptive purposes only, while not to be construed as indicating or implying relative importance or implicitly specifying the number of technical features indicated thereby, features defining "first," "second," and "second" may explicitly or implicitly include one or more of the described features. In the description of the present disclosure, "multiple" means two or more unless explicitly specified otherwise.

In addition, the terms "install", "arrange", "provide". "connect" and "couple" should be understood broadly. For example, it can be a fixed connection, a detachable connection, an integral structure, a mechanical connection, an electrical connection, a direct connection, an indirect connection through an intermediate medium, or a communication between two devices, elements or components. For ordinary technical personnel in this field, the specific meanings of the above terms in present disclosure can be understood based on specific circumstances.

In the present disclosure, unless specific regulation and limitation otherwise, the first feature "onto" or "under" the second feature may include the direct contact of the first feature and the second feature, or may include the contact of the first feature and the second feature through other features between them instead of direct contact. Moreover, the first feature "onto", "above" and "on" the second feature includes that the first feature is right above and obliquely above the second feature, or merely indicates that the horizontal height of the first feature is higher than the second feature. The first feature "under", "below" and "down" the second feature includes that the first feature is right above and obliquely above the second feature, or merely indicates that the horizontal height of the first feature is less than the second feature.

It should be noted that when an element is referred to as being "fixed to" another element, the element can be directly on another component or there can be a centered element. When an element is considered to be "connected" to another element, the element can be directly connected to another element or there may be a centered element. The terms "inner", "outer", "left", "right", and similar expressions used herein are for illustrative purposes only and do not necessarily represent the only implementation.

Referring to FIG. 1 to FIG. 10, a volleyball training device includes:

- a mounting mechanism 100 configured to secure the volleyball training device to a position for use;
- a collection mechanism 200 configured to receive and temporarily store balls; and
- a ball-control mechanism 300, wherein the ball-control mechanism 300 and/or the collection mechanism 200 is connected to the mounting mechanism 100, and the ball-control mechanism 300 is located below the collection mechanism 200; and wherein the ball-control mechanism 300 includes a ball-control assembly 310 defining a spiking position and configured to position a first ball 500; and an abutment member 320 rotatably connected to the ball-control assembly 310 and configured to selectively abut or release a second ball 600 from the collection mechanism 200; when the first ball 500 is spiked and moves out of the spiking position, the abutment member 320 rotates from an abutting state to a released state, to enable the second ball 600 descend to the spiking position.

By the arrangement of the above structure, during use, the mounting mechanism 100 securely attaches the volleyball training device to a position for use, such as a basketball hoop or a support rod, ensuring safety and precise positioning during training. The function of the ball collection mechanism 200 is to centrally store multiple volleyballs, which adapts to the training needs of different users or court conditions. As a temporary storage structure for volleyballs, the collection mechanism 200 ensures continuous ball feeding. The ball-control mechanism 300 serves as the core structure for achieving automatic continuous ball feeding. The ball-control assembly 310 defines the strike position, and positions the first ball 500 at a preset strike position. The ball-control assembly 310 can ensure consistent starting points for each user's striking, and enhance the standardization and repeatability of training. The collection mechanism 200 and/or the ball-control mechanism 300 are connected to the mounting mechanism 100 to ensure the stability of the volleyball training device. The abutment member 320, which can be rotatably connected to the ball-control assembly 310, abuts the second ball 600 located above the first ball 500. So that the abutment member 320 can prevent the second ball 600 from descending prematurely and avoid interference with user's spiking training. When a user spikes the first ball 500 located in the spiking position, then the first ball 500 moves out from the spiking position, the abutment member 320 is automatically triggered to rotate, enabling the abutment member 320 disengage (no longer abut) the second ball 600, while the abutment member 320 rotate from the abutting state to the released state against the second ball 600. Specifically, in the abutting state, the abutment member 320 abuts the second ball 600 to temporarily hold and avoid the second ball 600 from descending. In the released state, the abutment member 320 rotates and disengages from the second ball 600, allowing the second ball 600 to descend to the spiking position. There is no connection relationship between the second ball 600 and the abutment member 320. Once the abutment member 320 rotates (from the abutting state to the released state), the second ball 600 automatically descends to the spiking position under the gravity, enabling the user to prepare for the next striking training. This device significantly enhances training efficiency for the user, making the device an excellent choice for practicing volleyball spikes for both athletes and amateurs.

In this embodiment, the abutment member 320 includes a first rod 321 having a top end configured to abut or release the second ball 600, and also includes a second rod 322 connected to the first rod 321 and extending to the spiking position. When the second ball 600 is spiked and moves out, the second rod 322 drives the first rod 321 to rotate synchronously, to enable the second ball 600 to descend to the spiking position. By the arrangement of the above structure, the first rod 321 is located above the second rod 322, with its top end abutting the second ball 600. By the rotation of the first rod 321, the state of the second ball 600 is switched between the abutting state and the released state. The second rod 322 is connected to the first rod 321 and extends close to the spiking position, when a user spikes the first ball 500 located in the spiking position, then the first ball 500 moves out from the spiking position, then the second rod 322 is subject to the force of gravity. Due to the connection between the first rod 321 and the second rod 322, rotation of the second rod 322 drives the first rod 321 to rotate synchronously, causing the top end of the first rod 321 to disengage from the second ball 600 and switch from the abutting state to the released state. At this point, the second ball 600 is no longer supported by the first rod 321 and descends naturally under the force of gravity, accurately arriving at the spiking position for automatically replenish balls.

In this embodiment, the ball-control mechanism 300 includes a rotating shaft 330 configured to be rotatably connect to the ball-control assembly 310. The first rod 321 is configured to connect to the rotating shaft 330. By the arrangement of the above structure, the first rod 321 is rotatably connected to the ball-control assembly 310 via a rotating shaft 330, creating a well-defined junction that ensures consistent movement trajectory during each rotation. When the first ball 500 is spiked, then the first ball 500 moves out from the spiking position, and then the first ball 500 drives the rotation of the second rod 322 under its gravity. This rotation causes the entire abutment member 320 to rotate about the junction between the rotating shaft 330 and the first rod 321, resulting in the top end of the first rod 321 disengaging from the second ball 600 and thereby releasing the second ball 600. After releasing, the former second ball 600 descends to the spiking position and serves as the new first ball 500. The first rod 321 then abuts another ball from the collection mechanism 200, which subsequently becomes the new second ball 600. This process repeats cyclically to achieve automatic ball replenishment. It is to be noted that the rotating shaft 330 is of a hollow structure and is sleeved over a crossbar connected to the ball-control assembly 310 (alternatively, the rotating shaft 330 is sleeved over two oppositely located short crossbars). Owing to this hollow structure, the rotating shaft 330 is capable of rotating about the transverse rod, to enable the rotation of the abutment member 320.

In this embodiment, the abutment member 320 further includes a third rod 323 located at the junction of the first rod 321 and the second rod 322, and the third rod 323 having a free end extending away from the first rod 321. When the first ball 500 is spiked and moves out, the second rod 322 and the third rod 323 drive the first rod 321 to rotate synchronously, to enable the second ball 600 to descend to the spiking position. By the arrangement of the above structure, the third rod 323 functions as an auxiliary linkage rod (i.e., a counterweight rod) to reinforce the junction between the first rod 321 and the second rod 322. Additionally, the free end of the third rod 323 extends away from the first rod 321, so the third rod 323 is located closer to the second rod 322, thereby utilizing its own counterweight function. When a user spikes the first ball 500, then the first moves out from the spiking position, the second rod 322 drives the third rod 323 to rotate synchronously via the junction under its gravity, ensuring driving the first rod 321 rotate synchronously from the abutting state to the released state. In this way, the top end of the first rod 321 can accurately and timely release the second ball 600. In some embodiments, the third rod 323 may be replaced by a spring. In this case, one end of the spring is connected to the rod body of the first rod 321, while the other end is connected to the ball-control assembly 310. when the user spikes the first ball 500, then the first ball 500 moves out from the spiking position. After the first ball 500 moves, the second rod 322 is subjected to the effect of gravity, causing the spring to stretch. At this time, the collective action of the spring's elastic force and the gravity acting on the second rod 322 drives the first rod 321 to rotate synchronously around the junction. As a result, the top end of the first rod 321 disengages from the second ball 600, rotating from the abutting state to a released state.

Figure 2:
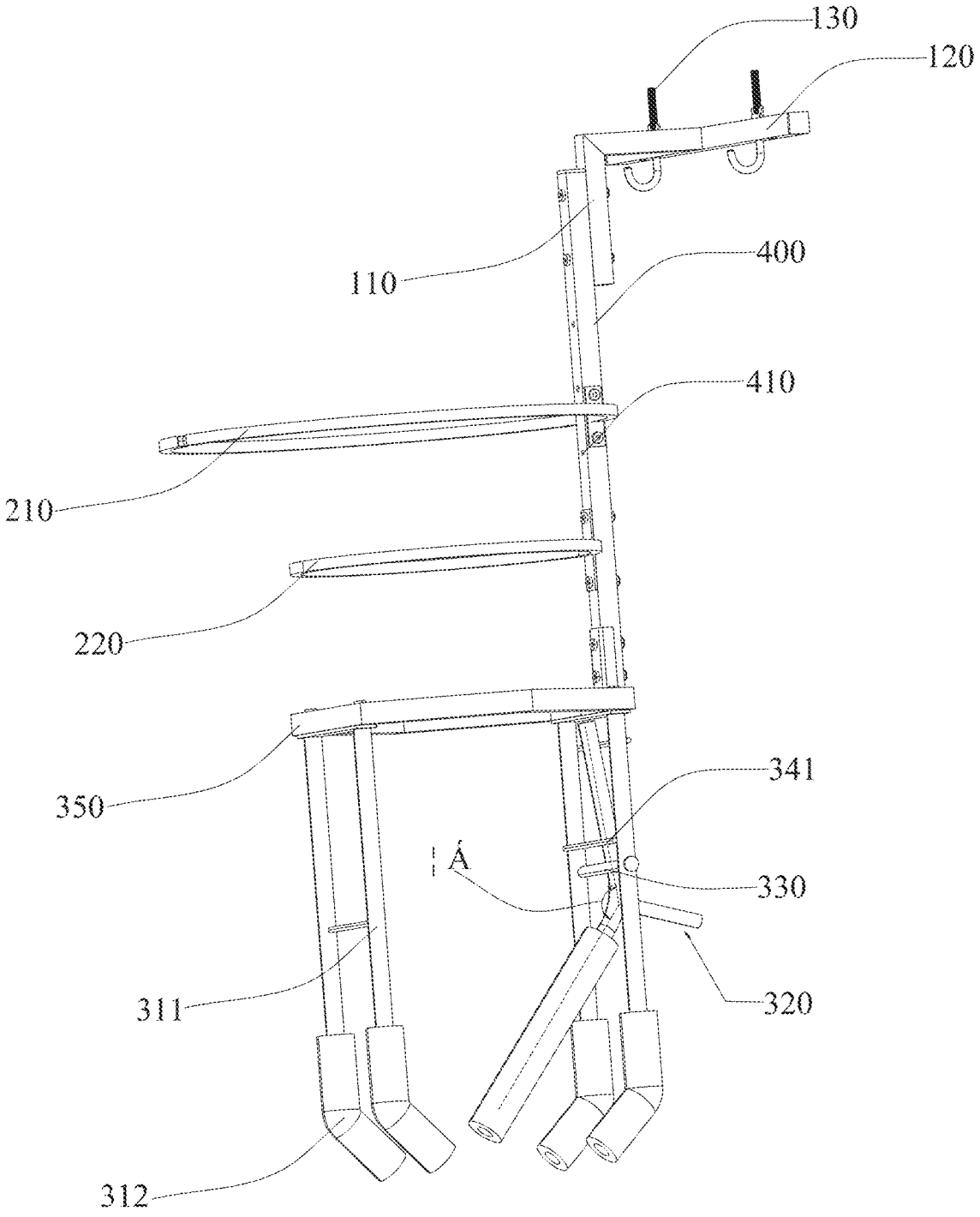
FIG. 2 shows another overall schematic structural view of the disclosure.
Figure 3:
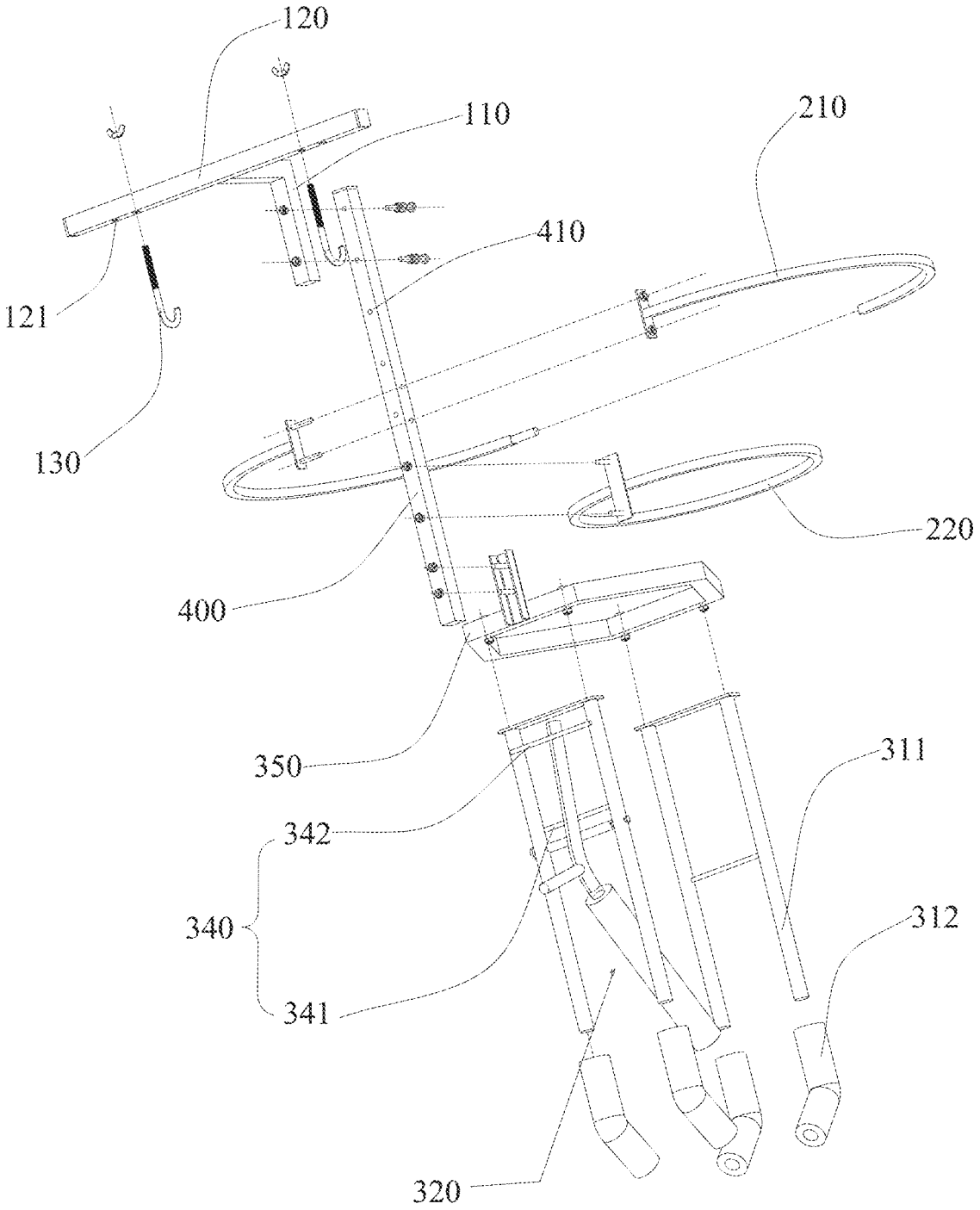
FIG. 3 shows an exploded view of the disclosure.

In this embodiment, the first rod 321 and the second rod 322 are a one-piece structure, and form a lever structure by a rotatable connection to the rotating shaft 330. By the arrangement of the above structure, the first rod 321, the junction between the first rod 321 and the rotating shaft 330, and the second rod 322 collectively form a lever structure. Using the junction between the first rod 321 and the rotating shaft 330 as a fulcrum, this lever structure enables force transmission and amplification. In particular, when the first ball 500 is spiked and moves out from the spiking position, the gravitational force acting on the second rod 322 (at this time, the second rod 322 serves as the effort arm of the lever structure) enables the second rod 322 to rotate. Due to the interconnected structure of the first rod 321, the second rod 322, and the third rod 323, the rotational movement of the second rod 322 is transmitted directly and without delay to the first rod 321 (at this time, the first rod 321 serves as the load arm of the lever structure). This causes the top end of the first rod 321 to rotate away from the second ball 600, rotating from the abutting state to the released state. Subsequently, the second ball 600 descends freely under the effect of gravity, accurately moving into the spiking position to complete the automatic replenishing volleyballs. The third rod 323 serves as an auxiliary linkage rod, assisting the second rod 322 in transmitting power and enhancing the overall entire stability. Additionally, the third rod 323 serves a motion guide structure, ensuring repeatable precision of the release and reset action of the first rod 321. In the absence of external force, the first rod 321 is in the released state, ensuring the balls from the collection mechanism 200 can reliably descend into the spiking position. In other cases, if friction between the second ball 600 and other balls in the collection mechanism 200 hinders smooth descent, the user can manually pull back the third rod 323 to allow the release of the second ball 600. It should be noted that the weight of the second rod 322 is greater than that of the third rod 323, but less than the weight of a volleyball. This configuration ensures that all three rods can effectively fulfill their respective roles, both in the absence of external force and during the rotation from the abutting state to the released state. Furthermore, as shown in FIG. 2, the angle α between the first rod 321 and the second rod 322 is approximately 135°.

In this embodiment, the ball-control mechanism 300 further includes a stop assembly 340 connected to the ball-control assembly 310. The first rod 321 is configured to abut rotatably the stop assembly 340, to enable the first rod 321 to abut or release the second ball 600. By the arrangement of the above structure, the ball-control mechanism 300 further includes the stop assembly 340 connected to the ball-control assembly 310. The stop assembly 340 serves as a rotational support base for the abutment member 320, enabling the first rod 321 to rotate stably. Thereby, reliable abutment and precise release of the second ball 600 are achieved. In particular, the stop assembly 340 is fixed connected to the ball-control assembly 310. Serving as a limiting structure for the abutment member 320, the stop assembly 340 ensures the abutment member 320 including the first rod 321, the second rod 322 and the third rod 323 can rotate smoothly and stably. The first rod 321 is rotatably abutted to the stop assembly 340, ensuring repeatable motion trajectories during each operation. When the first ball 500 is spiked, and then the first ball 500 moves out away from the spiking position, gravitational force drives the second rod 322 to rotate. Under the constraint of the stop assembly 340, the rotation of the second rod 322 drives the entire abutment member 320 to rotate, thereby causing the top end of the first rod 321 to disengage from the second ball 600 and effect the release of the second ball 600. After the release, the former second ball 600 descends to the spiking position and serves as the new first ball 500. The first rod 321 then abuts another ball from the collection mechanism 200, which subsequently becomes the new second ball 600. This process repeats cyclically to enable continuous ball replenishing.

In this embodiment, the stop assembly 340 includes a first stop rod 341 and a second stop rod 342 respectively connected to the ball-control assembly 310. In the abutting state, the first rod 321 abuts the first stop rod 341. In the released state, the first rod 321 abuts the second stop rod 342. By the arrangement of the above structure, the stop assembly 340 further includes the first stop rod 341 and the second stop rod 342. Both are fixedly connected to the ball-control assembly 310 and function to provide precise rotational limitation and positioning for state rotation of the abutment member 320 (particularly the first rod 321). This ensures reliable rotating between the abutting and releasing actions within a predefined angular range. In particularly, in the abutting state, while the top end of the first rod 321 abuts the second ball 600, the rod body of the first rod 321 abuts the first stop rod 341. At this time, the first stop rod 341 functions as an abutment stop structure that defines the initial position of the abutment member 320, avoiding unintended movement due to vibration or external forces and ensuring the second ball 600 is reliably held in the ready-to-drop position. In the released state, the abutment member 320 rotates around the rotating shaft 330 under the force of gravity, causing the first rod 321 to rotate until its rod body abuts the second stop rod 342. At this time, the second stop rod 342 functions as a release-side stop structure that restricts the maximum rotation angle of the abutment member 320. This prevents over-rotation of the abutment member 320, thereby avoiding difficulties in resetting, while ensuring that the second ball 600 completely disengages from the abutting area and descends smoothly to the spiking position. It should be noted that the rotational angle of the first rod 321 between the first stop rod 341 and the second stop rod 342 is approximately 35°. Specifically, in the abutting state, the rod body of the first rod 321 abuts the first stop rod 341. At this time, the angle between the first rod 321 and the ball-control assembly 310 is approximately 35°. In the released state, the rod body of the first rod 321 abuts the second stop rod 342. At this time, the angle between the second rod 322 and the ball-control assembly 310 is approximately 35°. This structure ensures reliable rotation and reset capability of the abutment member 320.

In this embodiment, the first stop rod 341 and the second stop rod 342 are disposed spaced apart. The first stop rod 341 is located close to the collection mechanism 200. The second stop rod 342 is located close to the spiking position. By the arrangement of the above structure, the first stop rod 341 and the second stop rod 342 are spaced apart. The first stop rod 341 is located close to the collection mechanism 200, and the second stop rod 342 is located close to the spike position. This structure achieves an efficient alignment between the movement path of the abutment member 320 and the volleyball release logic, further optimizing the coordination of actions and spatial efficiency of the ball-control mechanism 300. Specifically, the first stop rod 341 is located close to the collection mechanism 200, in the released state, the rod body of the first rod 321 abuts the first stop rod 341. This location is nearer to the second ball 600, ensuring that when the abutment member 320 is in the abutting state, the top end of the first rod 321 fully extends beneath the collection mechanism 200. It can provide secure retention of the second ball 600 and prevents its accidental release prior to triggering. The second stop rod 342 is located close to the spiking position, when the abutment member 320 rotates into the released state, the first rod 321 rotates about the rotating shaft 330 toward the spiking position until its rod body abuts the second stop rod 342. Owing to the proximity of the second stop rod 342 to the spiking position, the rotational endpoint of the abutment member 320 is located adjacent to the descent path of the second ball 600. This ensures that the first rod 321 completely clears the downward trajectory of the second ball 600, allowing the ball to descend vertically and unobstructed into the spiking position, thereby enhancing the efficiency of ball replenishment.

In this embodiment, the ball-control mechanism 300 includes a ball retention frame 350 connected below the collection mechanism 200. The ball retention frame 350 cooperates with the collection mechanism 200 to position the second ball 600, to enable the top end of the first rod 321 to abut the second ball 600. By the arrangement of the above structure, the ball-control mechanism 300 further includes the ball retention frame 350. The ball retention frame 350 is connected below the collection mechanism 200. The ball retention frame 350 is located above the ball-control assembly 310, and cooperates with the collection mechanism 200 to per-position the second ball 600. This ensures that the top end of the first rod 321 can reliably abut and support the second ball 600, providing structural assurance for the smooth execution of the automatic ball-replenishing motion. Specifically, the ball retention frame 350, serving as a transitional support and guide structure, is located between the collection mechanism 200 and the ball-control assembly 310. Its inner cavity is dimensioned to correspond to the diameter of a volleyball, allowing it to temporarily hold a single volleyball (i.e., the second ball 600). When the first ball 500 is spiked, and then it moves out sway from the spiking position, the second ball 600 descends into the spiking position under its own force of gravity. Simultaneously, another ball from the collection mechanism 200 enters the defined area of the ball control frame 350, becoming the new second ball 600. At that point, both the ball retention frame 350 and the collection mechanism 200 are defining a stable abutting area, to hold the new second ball 600 in the stable abutting area. This ensures that the top end of the first rod 321 can abut the bottom surface of the new second ball 600, preventing the new second ball 600 premature descent, and thereby sustaining the cyclical repetition of spiking training.

In this embodiment, the collection mechanism 200 includes a first collection frame 210 and a second collection frame 220 located adjacent to the ball retention frame 350. The second collection frame 220 and the ball retention frame 350 are jointly configured to position the second ball 600. By the arrangement of the above structure, the collection mechanism 200 is arranged a tiered collection frame, including the first collection frame 210 and the second collection frame 220. The second collection frame 220 is located adjacent to the ball retention frame 350 and works therewith to precisely position and stably hold the second ball 600. Specifically, the first collection frame 210 serves as a primary storage area for collectively housing more volleyballs. The first collection frame 210 provides ample housing space to support extended continuous training sessions without requiring frequent ball replenishment. The first collection frame 210 provides ample housing space to support extended continuous training without requiring frequent ball replenishment. The function of the second collection frame 220 is as an intermediate buffer area, located below the first collection frame 210 and adjacent to the ball retention frame 350. With a capacity typically accommodating only one single volleyball, it functions to guide volleyballs from the first collection frame 210 one by one into a defined area jointly defined by the second collection frame 220 and the ball retention frame 350. When the first ball 500 is spiked and moves out, the former second ball 600 descends into the spiking position for replacing the former first ball 500. Then the next ball from the first collection frame 210 automatically descends into the defined area defined by the second collection frame 220 and the ball retention frame 350, thereby completing the ball replenishment. The second collection frame 220 and the ball retention frame 350 are arranged in a vertical stack with the second collection frame above the ball retention frame 350. This vertical stack enables them to cooperatively restrict the periphery of the second ball 600, forming a stable spatially constrained area. To be specific, the second collection frame 220 restricts lateral movement of the second ball 600 from above and from one side; while the ball retention frame 350 provides support and guidance from below and from an opposing side. Together with the abutment force applied by the first rod 321, these three members cooperatively hold the second ball 600 in the stable spatially constrained area. In some cases, the first collection frame 210 and the second collection frame 220 are designed as annular structures. The first collection frame 210 is composed of two hollow semicircular ring structures, inserting a coupling member into their hollow sections to form the complete first collection frame 210, thereby facilitating disassembly and storage.

In this embodiment, the diameter of the first collection frame 210 is greater than the diameter of the second collection frame 220. By the arrangement of the above structure, the first collection frame 210 has a diameter larger than that of the second collection frame 220, forming a stepped ball-storage structure with an upper structure wider than the lower structure. This not only optimizes volleyball collection capacity and downward guiding performance, but also enhances the overall stability and ball supply efficiency of the collection mechanism 200. Specifically, the first collection frame 210 has a larger diameter and serves as a primary collection area capable of holding more volleyballs, making it suitable for high-intensity and prolonged training. The second collection frame 220, with its smaller diameter, serves as a transitional holding structure that allows only a single volleyball to pass through or hold each training. Its constricted opening structure provides a "selective and flow-guiding" effect: volleyballs descending from the first collection frame 210 are automatically screened and centered as they descend the second collection frame 220, ensuring only one ball at a time descends to become the second ball 600, thereby preventing multi-ball jamming or blockage. Owing to the larger diameter of the first collection frame 210, its bottom edge can be configured to support or restrict the second collection frame 220. Under the force of gravity, the volleyball slides from the larger diameter first collection frame 210 into the smaller diameter second collection frame 220, forming a smooth descending path that avoids ball jams or accumulation. Additionally, Simultaneously, this stepped ball-storage structure can help automatically center the volleyballs, improving positional consistency within the second collection frame 220.

In this embodiment, the volleyball training device further includes an adjustment mechanism 400 connected to the collection mechanism 200. The adjustment mechanism 400 is movably connected to the mounting mechanism 100 to adjust the virtual distance between the mounting mechanism 100 and the spiking position. By the arrangement of the above structure, the volleyball training device further includes the adjustment mechanism 400. One end of the adjustment mechanism 400 is connected to the collection mechanism 200, while the other end is movably connected to the mounting mechanism 100, to adjust the virtual distance between the mounting mechanism 100 and the spiking position. The adjustable connection enables flexible adaptation of the training height to meet athletes of different heights, diverse training motions, various technical and tactical requirements. When the adjustment mechanism 400 is extended, the collection mechanism 200 and the ball-control assembly 310 are lowered as a whole, bringing the spiking position closer to the ground. This is suitable for youth or low-net training. Conversely, shortening the adjustment mechanism 400 raises the spiking position, allowing simulation of spiking training at standard height for adult athletes or competition matches.

It should be noted that when the ball-control mechanism 300 is connected to the mounting mechanism 100, the mounting mechanism 100 is movably connected to the adjustment mechanism 400, the mounting mechanism 100 is connected to a support rod resting on the ground. In this case, at least a portion of the support rod effectively serves as the adjustment mechanism 400. The adjustment mechanism 400 may be implemented as a telescopic tubular structure. By extending or retracting this telescopic structure, the vertical distance between the spiking position and the ground can be adjusted as required.

In this embodiment, the first collection frame 210 and the second collection frame 220 are respectively connected to the adjustment mechanism 400. The first collection frame 210 is located above the second collection frame 220. By the arrangement of the above structure, due to both the first collection frame 210 and the second collection frame 220 are connected to the adjustment mechanism 400, both frames to move synchronously as a whole when the adjustment mechanism 400 is adjusted, to ensure that volleyballs can smoothly descend from the upper first collection frame 210 into the lower second collection frame 220. The first collection frame 210 is vertically located above the second collection frame 220, meeting the logic of gravity and enabling the sequential descent of volleyballs under gravitational force. When the adjustment mechanism 400 is adjusted the vertical distance between the mounting mechanism 100 and the spiking position, the collection mechanism 200 moves synchronously with the adjustment mechanism 400. This synchronized movement maintains a constant spatial relationship between the second collection frame 220, the ball retention frame 350, and the spiking position, ensuring that volleyballs from the collection mechanism 200 consistently descend into the ball retention frame 350 and are reliably abutted by the first rod 321 to be the second ball 600.

In this embodiment, the adjustment mechanism 400 is provided a plurality of oppositely disposed adjustment holes 410 and fasteners. The fasteners passes through the adjustment holes 410 to movably connect the mounting mechanism 100 to the adjustment mechanism 400. By the arrangement of the above structure, the adjustment mechanism 400 is provided a plurality of oppositely disposed adjustment holes 410. The fasteners are passed through these adjustment holes 410 to form a movable connection between the mounting mechanism 100 and the adjustment mechanism 400, thereby forming an adjustable connection. This adjustable connection enables multi-level vertical adjustment of the collection mechanism 200 and the ball-control mechanism 300 relative to the mounting mechanism 100. In some embodiments, the adjustment holes 410 are spaced vertically along the adjustment mechanism 400, forming a series of upper and lower opposite through holes that define multiple preset height levels. The mounting mechanism 100 engages with the adjustment hole 410 to securely connect the adjustment mechanism 400 to the mounting mechanism 100. When adjusting the height of the spiking position, the adjustment mechanism 400—along with the attached collection mechanism 200 and ball-control mechanism 300—is moved vertically along the adjustment holes 410 to the target height. Since the adjustment holes 410 are oppositely arranged, balancing the force distribution during adjustment, enhancing the stability and safety of the device.

In this embodiment, the mounting mechanism 100 includes a connecting member 110 having a vertical bar detachably connected to the adjustment holes 410 by the fasteners. By the arrangement of the above structure, the connecting member 110, serving as the core connecting structure of the mounting mechanism 100, can be designed as an L-shaped connecting arm. It has function of movably connecting the entire mounting mechanism 100 to the adjustment mechanism 400. The user can select the adjustment holes 410 at different heights for fixing the mounting mechanism 100 based on needs, thereby precisely adjusting the vertical height of the spiking position.

In this embodiment, the mounting mechanism 100 includes a hanging member 120 connected to a crossbar of the connecting member 110. The hanging member 120 is configured to secure the volleyball training device to the position for use. By the arrangement of the above structure, the hanging member 120 serves as a final connection structure between the volleyball training device and other support structure (e.g., basketball hoop, volleyball net post, beam, or vertical rod), to secure the volleyball training device to the position for use. In some embodiments, the hanging member 120 is preferably configured as a crossbar, with the crossbar of the connecting member 110 attached to it. For example, the hanging member 120 may be directly mounted on a crossbar of a hoop support frame. Since the connecting member 110 is already adjusted height through the adjustment holes 410, the hanging member 120 enables the device to flexibly adapt to various heights and installation angles in different training environments without modifications to its main structure.

In this embodiment, the hanging member 120 is provided a plurality of oppositely disposed hanging holes 121. The mounting mechanism 100 further includes J-shaped members 130 passing through the hanging holes 121 to secure the hanging member 120 to the position for use. By the arrangement of the above structure, The J-shaped members 130 can pass through the hanging holes 121 to secure the hanging member 120 to the support structure, enabling quick, reliable, and adjustable installation. Specifically, the J-shaped members 130, like the letter "J" in shape, including a curved hook and a straight rod. The curved hook can be engage with the crossbar of a basketball hoop, while the straight rod passes through the hanging holes 121 on the hanging member 120, forming a mechanical connecting. The hanging holes 121 are arranged in pairs (e.g., symmetrically upper and lower) on the hanging member 120 to ensure that the J-shaped members 130 remain level and centered after insertion. The J-shaped members 130 can enable a "insert-and-press" installation way, working in conjunction with the hanging holes 121 to allow rapid positioning and significantly reduce assembly and disassembly time. It should be noted that the J-shaped members 130 pass through the hanging holes 121 and secures the hanging member 120 to the position for use by nuts.

Figure 4:
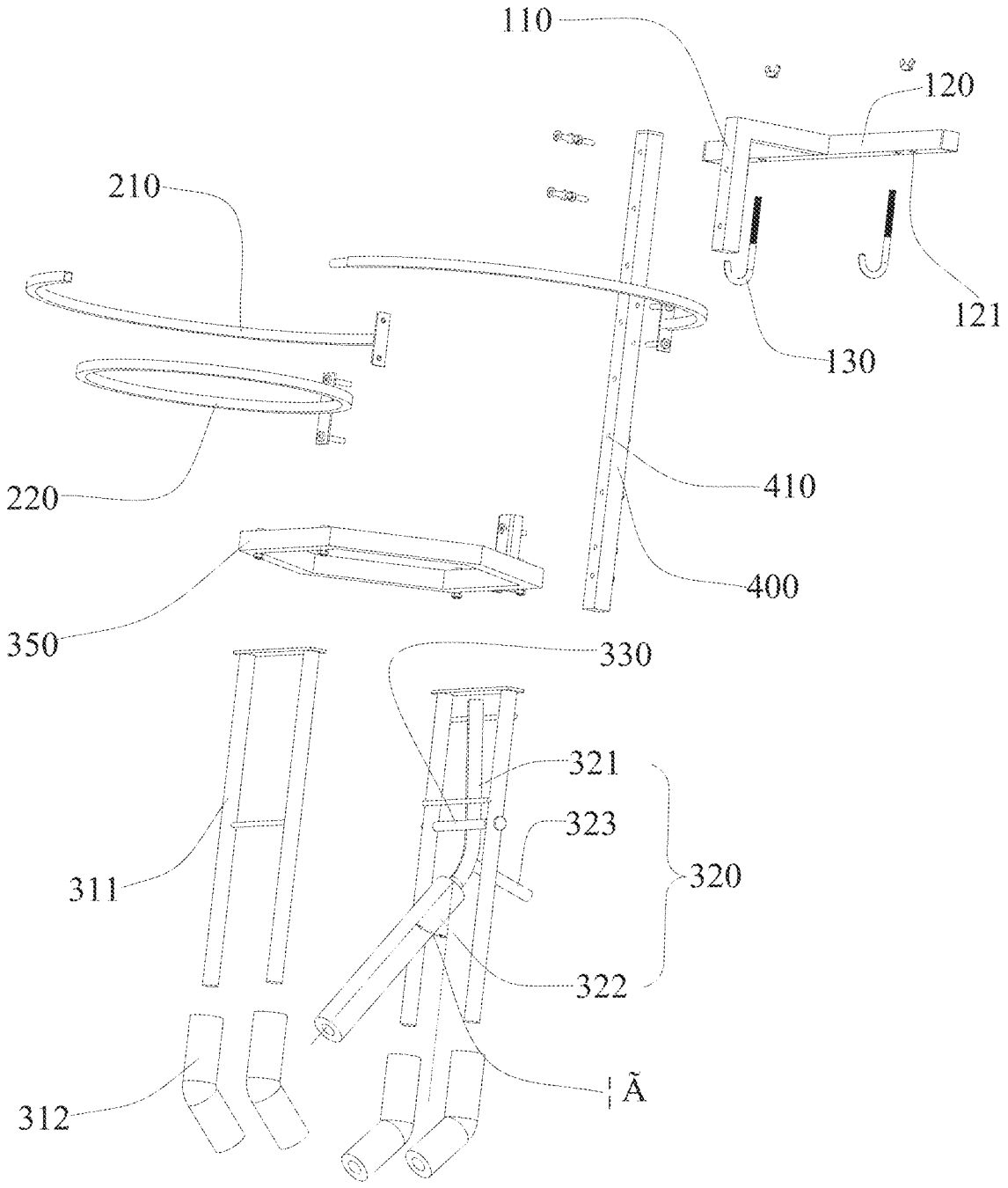
FIG. 4 shows another exploded view of the disclosure.
Figure 5:
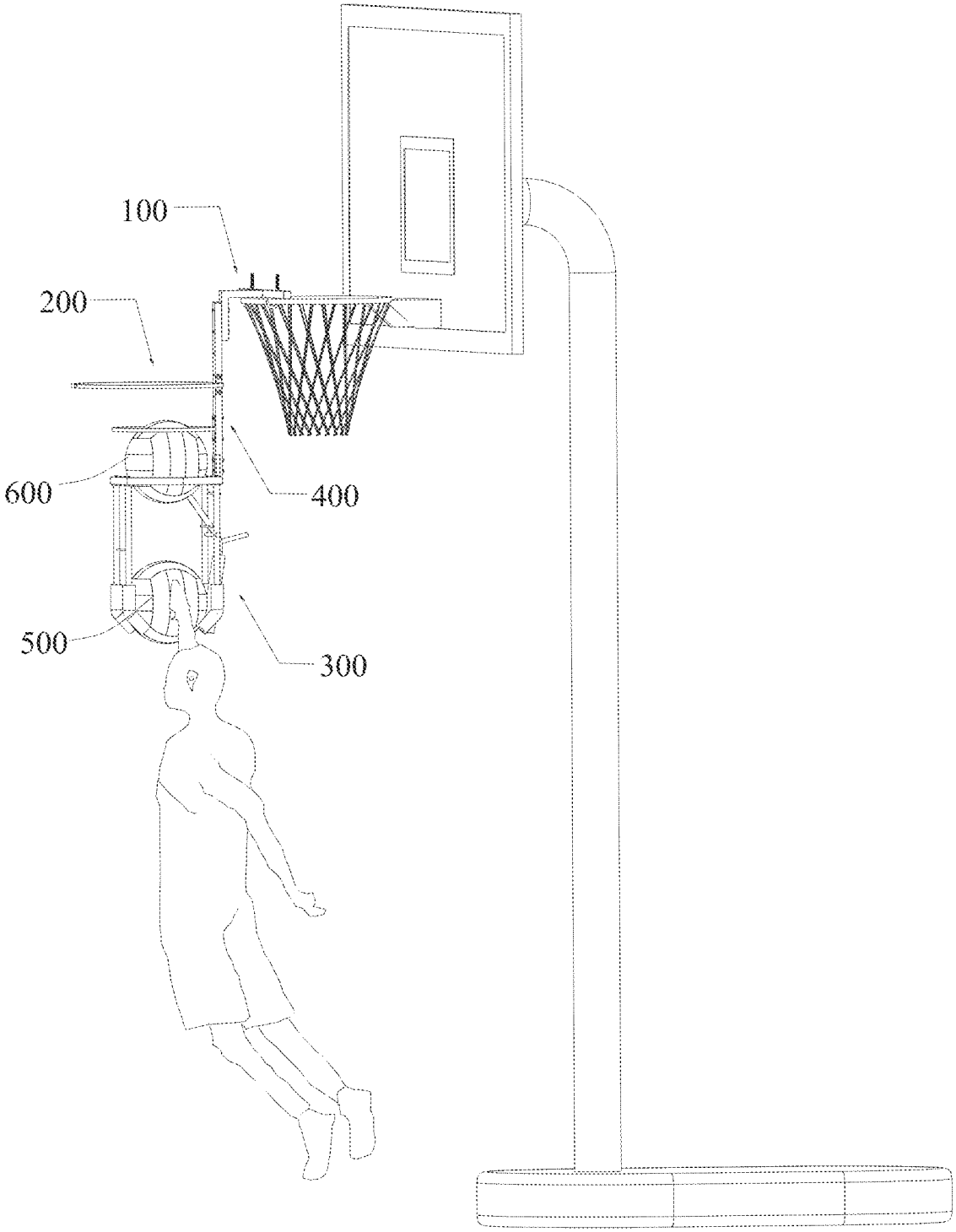
FIG. 5 shows an overall schematic structural view of the disclosure in a first usage state.
Figure 6:
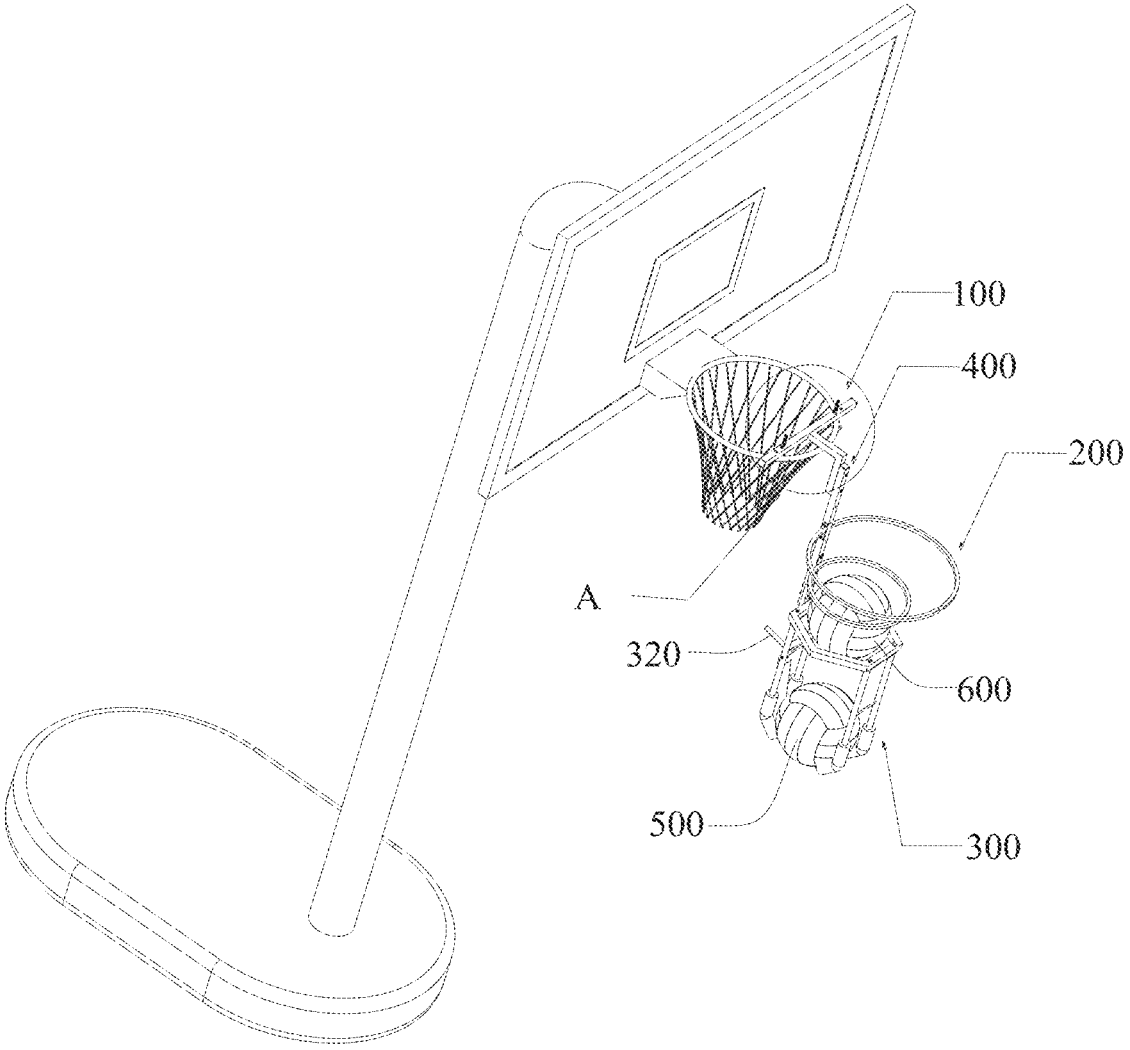
FIG. 6 shows another overall schematic structural view of the disclosure in a first usage state.
Figure 7:
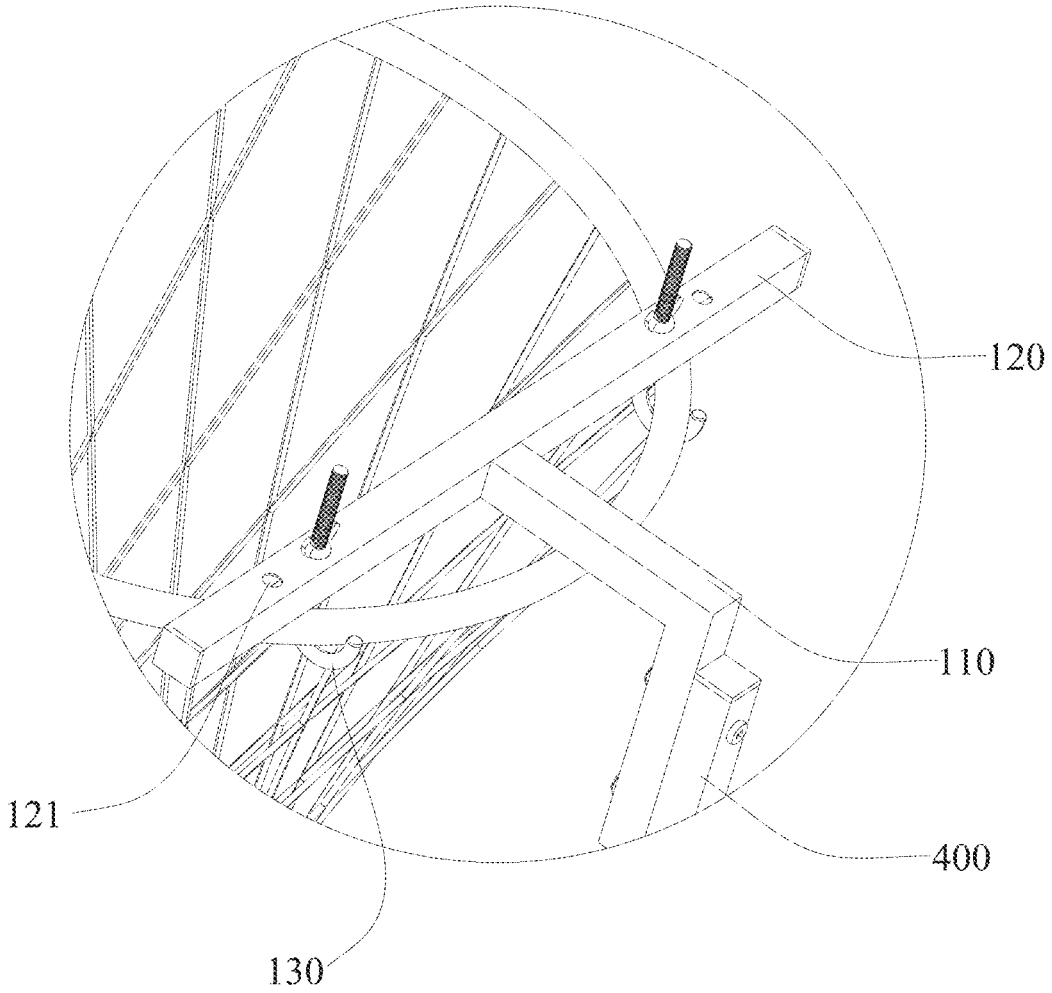
FIG. 7 shows an enlarged view of the circle A in FIG. 6.
Figure 8:
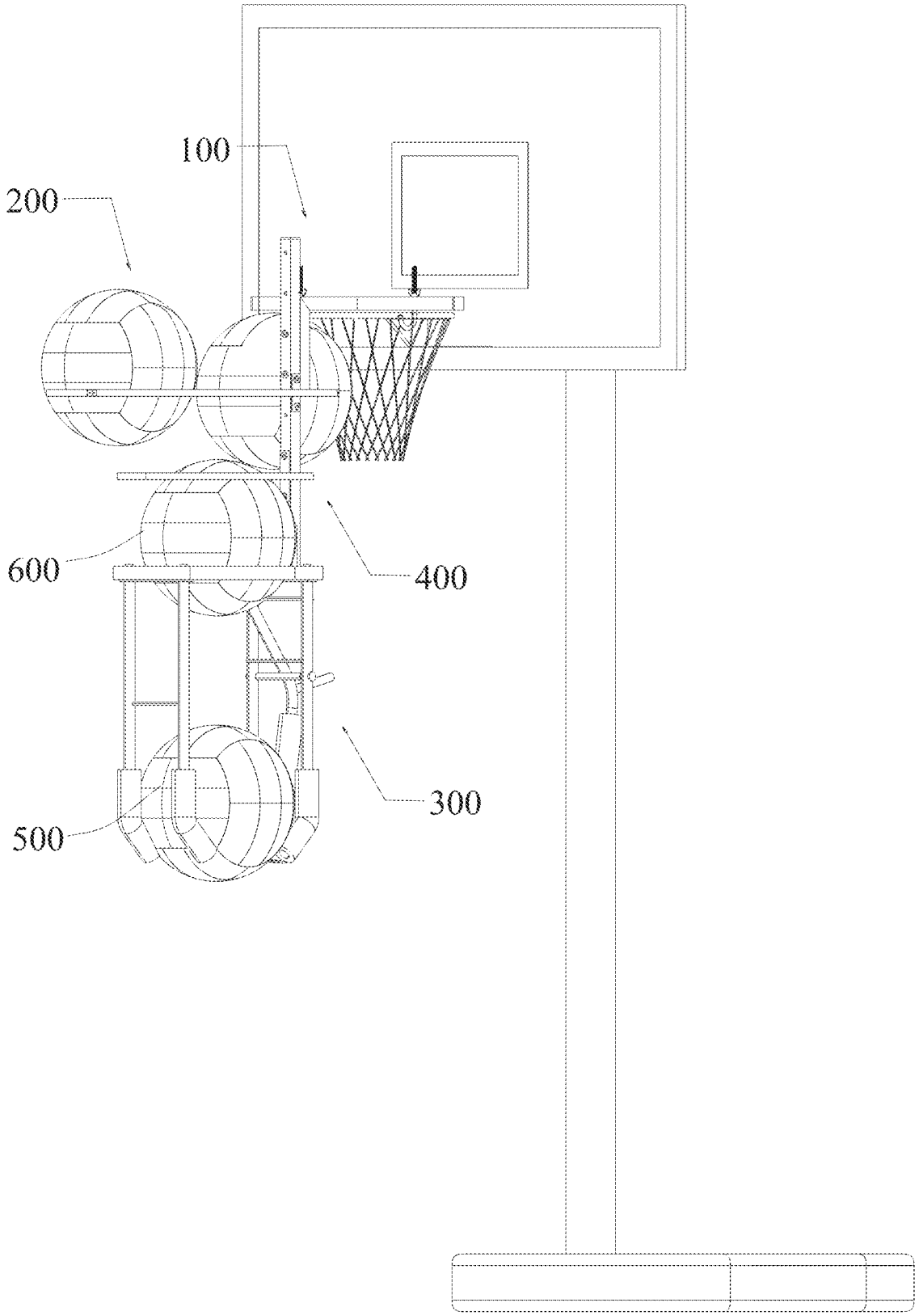
FIG. 8 shows an overall schematic structural view of the disclosure in a second usage state.
Figure 9:
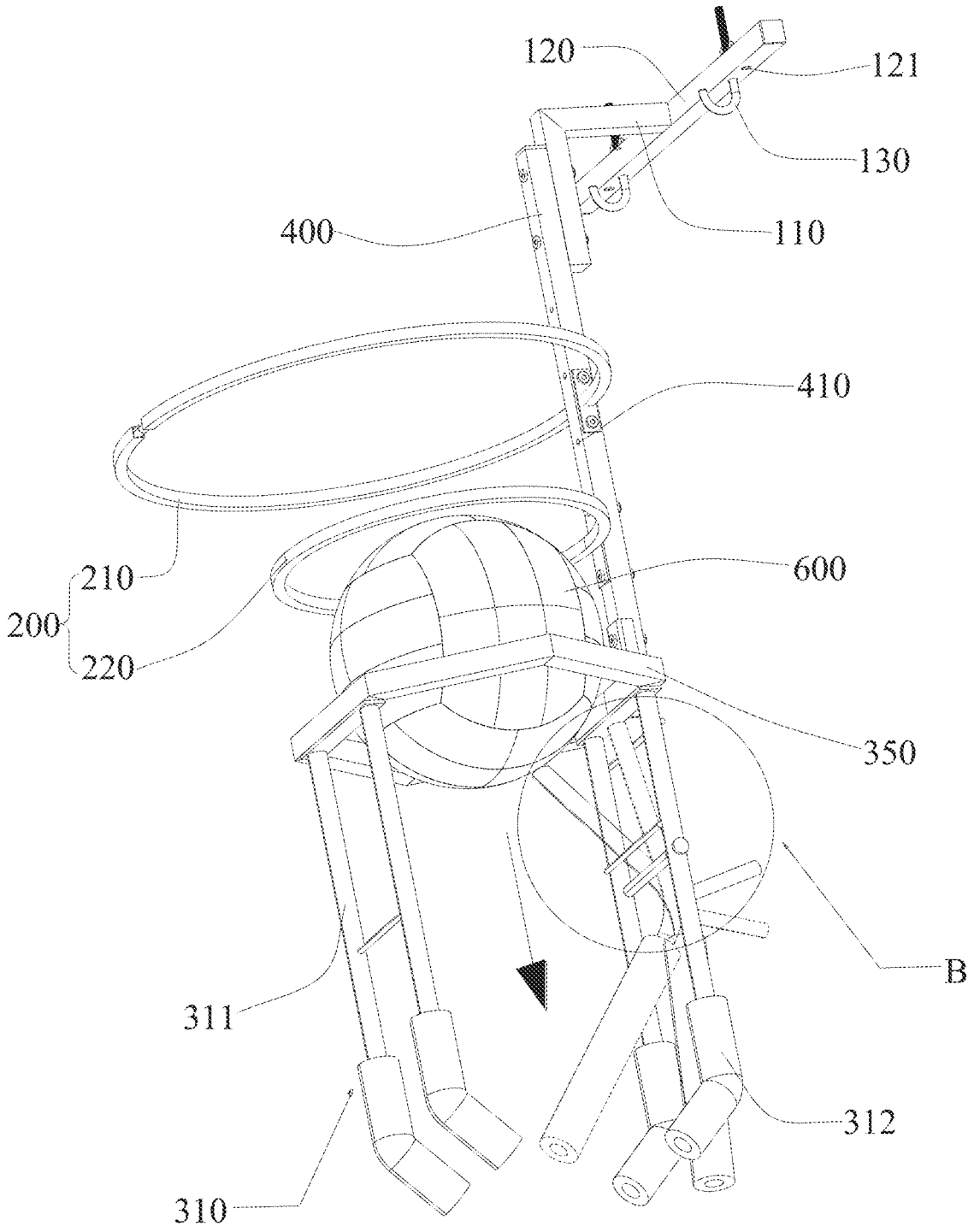
FIG. 9 shows an overall schematic structural view of the abutment member rotates from the abutting state to the released state.
Figure 10:
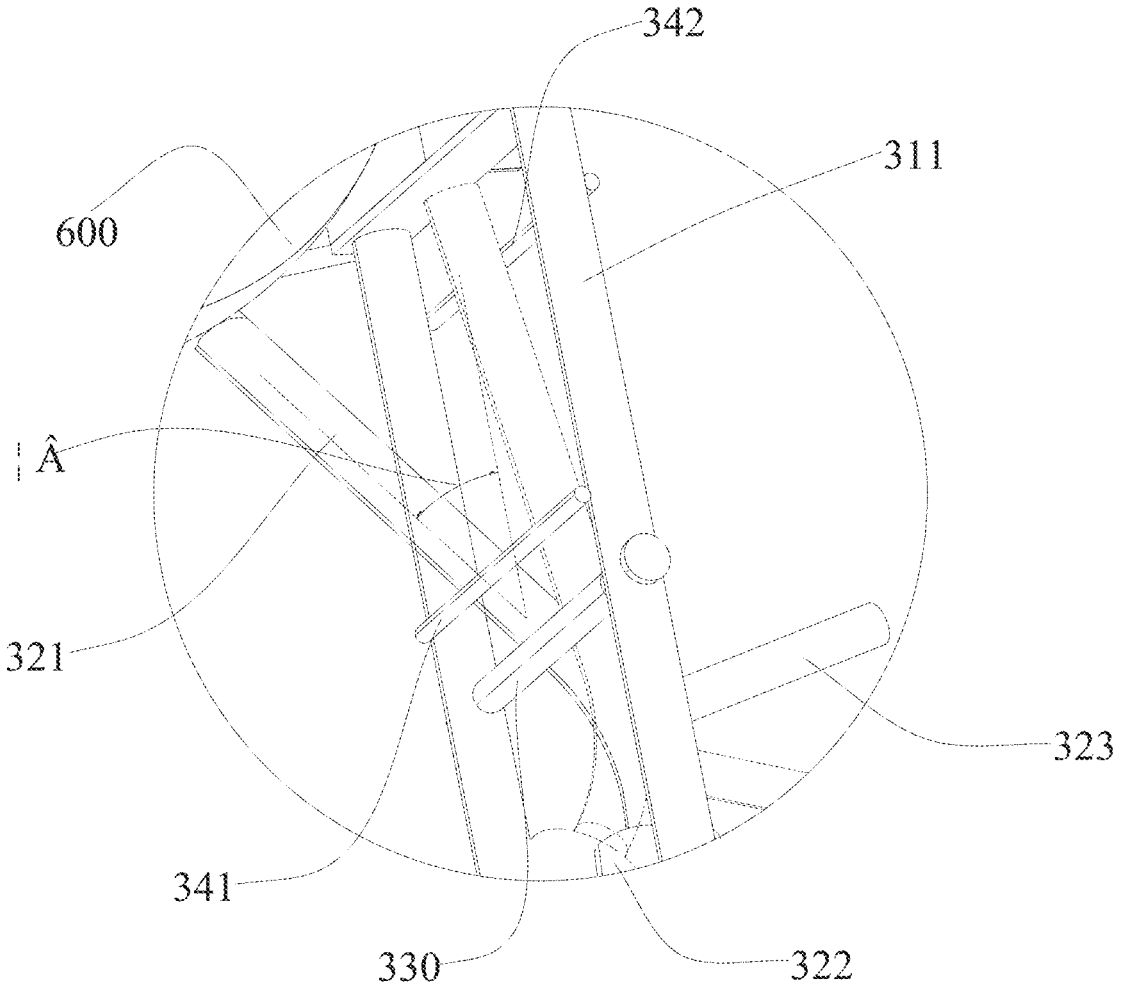
FIG. 10 shows an enlarged view of the circle B in FIG. 9.

In this embodiment, the ball-control assembly 310 includes a plurality of retention rods 311, bottoms of the retention rods define the spiking position. By the arrangement of the above structure, the ball control assembly 310 includes multiple retention rods 311, whose bottoms collectively define a clear and stable spiking position. These retention rods 311 ensure reliable support for the first ball 500 and provide a precise striking point for automated continuous training. Specifically, the multiple retention rods 311 extend downward in an annular layout, with their ends forming an area in space. This area is the spiking position. When the first ball 500 is located on this area, it is securely located by the bottoms of the retention rods 311, holding a consistent preset height and location. This spiking position ensures height of the first ball 500 for each strike, enhancing the standardization and repeatability of spiking training. In this case, in the abutting state, the rod body of the first rod 321 abuts the first stop rod 341. As shown in FIG. 10. the angle β between the first rod 321 and the retention rods 311 (i.e., the vertical direction) is approximately 35°. In the released state, the rod body of the first rod 321 abuts the second stop rod 342. As shown in FIG. 4, the angle γ between the second rod 322 and the retention rods 311 (i.e., the vertical direction) is also approximately 35°.

In this embodiment, a number of the retention rods 311 is at least two. The retention rods 311 are symmetrically disposed. By the arrangement of the above structure, when two or more retention rods 311 are arranged, they collectively act on the second ball 600 to form a spatially constrained area that restricts the ball's freedom of movement in both horizontal and vertical directions. The bottoms of the retention rods 311 collectively define the spiking position, the center of which serves as the standard striking point. This ensures that the volleyball consistently remains at the same position and height, aiding users in developing stable spiking motions and muscle memory. At least two retention rods 311 allows for structural strength while achieving lightweight construction and visual openness. It enables the structure to withstand both the impact of descending balls and the reaction forces from spikes, without excessively obstructing the spike space. This may facilitate smooth rotation of the abutment member 320 (e.g., the first rod 321 and the second rod 322) within these retention rods 311, reducing structural interference. Preferably, the multiple retention rods 311 can be symmetrically distributed (e.g., arranged in opposing pairs, a triangular layout, or a circular ring configuration) to further balance force, preventing tilting or bouncing of the ball due to unbalanced force.

In this embodiment, the ball-control assembly 310 further includes flexible pads 312 detachably sleeved the bottoms of the retention rods 311. By the arrangement of the above structure, the flexible pads 312, made of flexible material (e.g., silicone, rubber, TPE, and so on), are sleeved over the end or surface of the bottoms of the retention rods 311, and directly abut the surface of the first ball 500 at the spiking position. The function of the retention rods is to enhance friction and conformity with the ball through slight deformation of the flexible material when the first ball 500 is held at the spiking position. The flexible pads 312 prevent the first ball 500 from sliding, rolling, or bouncing due to minor vibrations or airflow during the waiting time before striking, thereby achieving more reliable static positioning. The detachable flexible pads 312 allow users to replace with pads of different hardness, material, or color according to usage conditions, adapting to various training environments. It should be noted that the flexible pads 312 may be configured as a bent structure, for example, with an inwardly curved shape such that its bottom extends toward the center of the spiking position. It is enables better wrapping or restraint of the bottom of the first ball 500, significantly enhancing the confinement of the spiking position. Correspondingly, the bottom of the second rod 322 is also sleeved with a flexible pad 312.

As described above, one or more embodiments are provided in conjunction with the detailed description. The specific implementation of the present disclosure is not confirmed to be limited to that the description is similar to or similar to the method, the structure and the like of the present disclosure, or a plurality of technical deductions or substitutions are made on the premise of the conception of the present disclosure to be regarded as the protection of the present disclosure.

The invention claimed is:

1. A volleyball training device, comprising:

a mounting mechanism configured to secure the volleyball training device to a position for use;

a collection mechanism configured to receive and temporarily store balls; and a ball-control mechanism, wherein the ball-control mechanism and the collection mechanism are connected to the mounting mechanism, and the ball-control mechanism is positioned below the collection mechanism; and wherein the ball-control mechanism comprises a ball-control assembly defining a spiking position and configured to position a first ball; and an abutment member rotatably connected to the ball-control assembly and configured to selectively abut or release a second ball from the collection mechanism; when the first ball is spiked and moves out of the spiking position, the abutment member rotates from an abutting state to a released state, to enable the second ball to descend to the spiking position;

wherein the abutment member comprises a first rod having a top end configured to abut or release the second ball; and a second rod connected to the first rod and extending to the spiking position; when the second ball is spiked and moves out, the second rod drives the first rod to rotate synchronously, to enable the second ball to descend to the spiking position.

2. The volleyball training device according to claim 1, wherein the ball-control mechanism comprises a rotating shaft configured to be rotatably connect to the ball-control assembly; and the first rod is configured to connect to the rotating shaft.

3. The volleyball training device according to claim 2, wherein the abutment member further comprises a third rod positioned at the junction of the first rod and the second rod, and the third rod having a free end extending away from the first rod; when the first ball is spiked and moves out, the second rod and the third rod drive the first rod to rotate synchronously, to enable the second ball to descend to the spiking position.

4. The volleyball training device according to claim 3, wherein the stop assembly comprises a first stop rod and a second stop rod respectively connected to the ball-control assembly, in the abutting state, the first rod abuts the first stop rod; in the released state, the first rod abuts the second stop rod.

5. The volleyball training device according to claim 3, wherein the first stop rod and the second stop rod are disposed spaced apart, the first stop rod is positioned close to the collection mechanism, the second stop rod is positioned close to the spiking position.

6. The volleyball training device according to claim 2, wherein the first rod and the second rod are a one-piece structure, and form a lever structure by a rotatable connection to the rotating shaft.

7. The volleyball training device according to claim 1, wherein the ball-control mechanism further comprises a stop assembly connected to the ball-control assembly; the first rod is configured to abut rotatably the stop assembly, to enable the first rod to abut or release the second ball.

8. The volleyball training device according to claim 1, wherein the ball-control mechanism comprises a ball retention frame connected below the collection mechanism, and the ball retention frame cooperates with the collection mechanism to position the second ball, to enable the top end of the first rod to abut the second ball.

9. The volleyball training device according to claim 8, wherein the collection mechanism comprises a first collection frame and a second collection frame positioned adjacent to the ball retention frame; and wherein the second collection frame and the ball retention frame are jointly configured to position the second ball.

10. The volleyball training device according to claim 9, wherein the diameter of the first collection frame is greater than the diameter of the second collection frame.

11. The volleyball training device according to claim 9, further comprising an adjustment mechanism connected to the collection mechanism, wherein the adjustment mechanism is movably connected to the mounting mechanism to adjust the virtual distance between the mounting mechanism and the spiking position.

12. The volleyball training device according to claim 11, wherein the first collection frame and the second collection frame are respectively connected to the adjustment mechanism, and the first collection frame is positioned above the second collection frame.

13. The volleyball training device according to claim 11, wherein the adjustment mechanism is provided a plurality of oppositely disposed adjustment holes and fasteners, the fasteners pass through the adjustment holes to movably connect the mounting mechanism to the adjustment mechanism.

14. The volleyball training device according to claim 13, wherein the mounting mechanism comprises a connecting member having a vertical bar detachably connected to the adjustment holes by the fasteners.

15. The volleyball training device according to claim 14, wherein the mounting mechanism comprises a hanging member connected to a crossbar of the connecting member; the hanging member is configured to secure the volleyball training device to the position for use.

16. The volleyball training device according to claim 15, wherein the hanging member is provided a plurality of oppositely disposed hanging holes, the mounting mechanism further comprises J-shaped members passing through the hanging holes to secure the hanging member to the position for use.

17. The volleyball training device according to claim 1, wherein the ball-control assembly comprises a plurality of retention rods, bottoms of the retention rods collectively define the spiking position.

18. The volleyball training device according to claim 17, wherein a number of the retention rods is at least two, and the retention rods are symmetrically disposed.

19. The volleyball training device according to claim 17, wherein the ball-control assembly further comprises flexible pads detachably sleeved the bottoms of the retention rods.

* * * * *